US006658769B2

(12) United States Patent
Klager

(10) Patent No.: US 6,658,769 B2
(45) Date of Patent: Dec. 9, 2003

(54) SELF-CLEANING HYDRAULIC CLAM BUCKET

(76) Inventor: Gene Klager, 306 Heather La., Conroe, TX (US) 77385

( * ) Notice: Subject to any disclaimer, the term of this patent is extended or adjusted under 35 U.S.C. 154(b) by 69 days.

(21) Appl. No.: 10/040,043

(22) Filed: Nov. 7, 2001

(65) Prior Publication Data

US 2002/0104236 A1 Aug. 8, 2002

Related U.S. Application Data

(63) Continuation-in-part of application No. 09/474,609, filed on Dec. 29, 1999, now Pat. No. 6,347,464.

(51) Int. Cl.[7] ..... E02F 3/40; B66C 3/00

(52) U.S. Cl. ..... 37/444; 37/901; 414/725

(58) Field of Search ..... 37/444, 445, 426, 37/901, 903, 443; 414/725, 726, 727

(56) References Cited

U.S. PATENT DOCUMENTS

| | | | | | |
|---|---|---|---|---|---|
| 1,653,905 | A | * | 12/1927 | Harrison | 37/444 |
| 2,719,641 | A | * | 10/1955 | Pilch | 414/704 |
| 2,812,872 | A | * | 11/1957 | Perkins et al. | 414/704 |
| 2,853,201 | A | * | 9/1958 | Davidson et al. | 414/725 |
| 2,864,518 | A | * | 12/1958 | Beyerstedt | 414/704 |
| 2,939,595 | A | * | 6/1960 | Waite | 414/725 |
| 3,092,920 | A | * | 6/1963 | Benno | 37/408 |
| 3,195,747 | A | * | 7/1965 | Kashergen | 414/694 |
| 3,229,835 | A | * | 1/1966 | Watts | 414/694 |
| 3,268,100 | A | * | 8/1966 | Drouillard | 414/694 |
| 3,380,604 | A | * | 4/1968 | Leese | 414/694 |
| 3,421,236 | A | * | 1/1969 | Moyer | 37/409 |
| 3,581,924 | A | * | 6/1971 | Marz | 414/704 |
| 4,030,626 | A | * | 6/1977 | Durham | 414/704 |
| 4,497,608 | A | * | 2/1985 | Sheppard et al. | 414/726 |
| 5,184,933 | A | * | 2/1993 | Pei-qian et al. | 414/725 |
| 5,743,030 | A | * | 4/1998 | Sirr | 37/406 |
| 6,052,926 | A | * | 4/2000 | Stephens | 37/444 |
| 6,341,933 | B1 | * | 1/2002 | Gagnon et al. | 414/725 |
| 6,347,464 | B1 | * | 2/2002 | Klager | 37/187 |

* cited by examiner

*Primary Examiner*—Victor Batson
(74) *Attorney, Agent, or Firm*—Mary J. Gaskin

(57) ABSTRACT

A bucket of a type designed to attach to the stick of an excavator, using pre-existing pins. The bucket is powered by a hydraulic cylinder, the lines of which attach to excavator controls. Striker forks are mounted onto the stick of the excavator at a predetermined position. The clean-out system is a wiper plate incorporated into the bucket as the "roof", which is designed to follow the inner contour of the sides of the bucket. As the bucket is filled, the wiper plate moves to the top of the bucket; when the bucket is emptied, the wiper plate contacts the striker forks, which force the material out of the bucket, preventing build-up of material on the inside of the bucket.

4 Claims, 4 Drawing Sheets

SELF-CLEANING HYDRAULIC CLAM BUCKET

CROSS-REFERENCE TO RELATED APPLICATIONS

This application is a continuation-in-part of application Ser. No. 09/474,609, filed on Dec. 29, 1999 now U.S. Pat. No. 6,347,464. That application claims a self-cleaning hydraulic clam bucket. This application claims a bucket (one-half of the clam) which functions is the same manner.

BACKGROUND—FIELD OF INVENTION

This invention relates to the construction industry, specifically to the excavation of the material in confined areas. It is directed to use on hydraulic excavators and loader backhoes.

BACKGROUND—DESCRIPTION OF PRIOR ART

Contractors from the beginning of mechanized excavation have looked for ways to excavate earth and material from confined areas and, depending on the material being excavated, have looked for a bucket that would clean out with each scoop so that the excavation could proceed more efficiently.

The original buckets worked off of steam driven winches and wire rope cables. This design stayed basically the same until the 1960's with the advent of hydraulic excavators.

Inventors then began to develop buckets based on the use of hydraulic power. U.S. Pat. No. 4,392,774 to Thomas (1983) discloses an attempt to develop a clam bucket using a single cable run through sheaves. The operating mechanism extends beyond the radius of the bucket limiting the accessible area of the attachment and making the arm susceptible to hanging inside a shored excavation. U.S. Pat. No. 5,228,735 to Morrow (1991) shows a clam bucket assembly which incorporates an elaborate linkage system, costly to manufacture and maintain. The hydraulic tubes are exposed, creating the possibility of breakage sending 180° fluid spraying into the atmosphere and/or onto workmen. This unit gives no extended reach to work over objects. Also, it has no bucket cleaner. U.S. Pat. No. 4,257,731 to Beaver (1978) demonstrates a clam bucket that does not increase digging depth. The assembly requires extra hydraulics from the host machine and uses an elaborate linkage system to operate the bucket, thus raising the cost to the consumer. This design, again, has no bucket cleaner. U.S. Pat. No. 3,920,137 to McCain (1974) shows a clam bucket assembly designed with a very elaborate mechanism that is costly to manufacture and maintain and does not increase digging depth or reach, and this patent claims no bucket cleaner.

The above-referenced buckets suffer from a number of disadvantages:

(a) Expensive and elaborate linkage mechanism. Costly to build and maintain.

(b) All hydraulic requirements use an extra system which has to be added to the host mechanism at an added cost.

(c) None of the previously patented buckets have a self-cleaning bucket which allows the removal of wet and sticky material that becomes trapped in the bucket.

SUMMARY OF THE INVENTION

In accordance with the present invention, a self-cleaning bucket is described, comprising a bucket with a hinged wiper plate, a striker assembly, and an hydraulic cylinder operated by standard hydraulic circuitry.

The bucket, which is mounted on the excavator stick, has a hinged "roof", or wiper plate, which is designed to follow the inner contour of the sides of the bucket. The wiper plate is forced to the top of the bucket as the bucket fills with dirt or other materials. The bucket hydraulic cylinder rotates the bucket, causing the wiper plate to come in contact with striker forks mounted on the excavator stick, thereby forcing the wiper plate downward, ejecting the dirt or other materials from the bucket.

Objects and Advantages

Accordingly, the objects and advantages of the self-cleaning hydraulic bucket are:

(a) a hydraulic bucket that requires no additional hydraulic circuitry to operate.

(b) self-cleaning bucket. The bucket cleans its internal dimension upon each dumping cycle, thus removing all types of material which stick and are packed into the bucket upon filling.

(c) workers do not have to manually clean out the bucket, lessening their exposure to contaminated materials and hazardous wastes.

(d) no elaborate mechanical linkage to maintain and wear out.

Further objects and advantages of the self-cleaning hydraulic bucket will become apparent from a consideration of the drawings and ensuing description.

Reference Numerals in Drawings

| | | | |
|---|---|---|---|
| 10 | hydraulic bucket | 12 | excavator stick |
| 14 | excavator | 16 | wiper plate |
| 18, 20 | bucket mounting plate | 22 | excavator pins |
| 24 | striker mounting plate | 26 | striker forks |
| 28 | bucket hydraulic cylinder | 30 | arm cylinder |
| 32, 34 | sidewalls | 36 | contoured bottom |
| 38 | cutting teeth | 40 | cutting edge |
| 42 | front tube | 44 | rear tube |
| 46, 48 | mounting bars | 50, 52 | pad eyes |
| 54, 56 | plate mounting pins | 58 | dirt |

BRIEF DESCRIPTION OF THE PREFERRED EMBODIMENT

Figure 1:
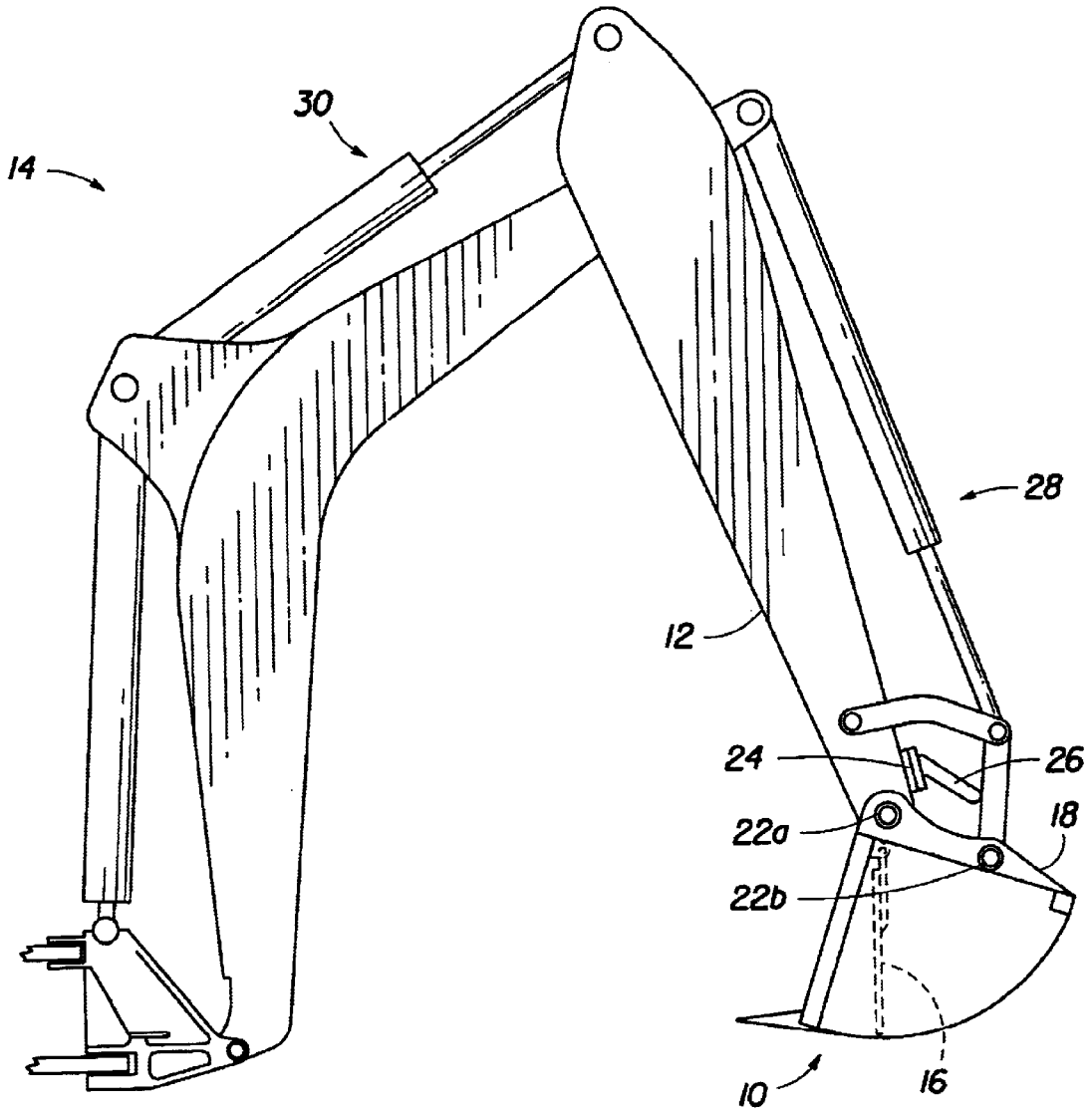
FIG. 1 shows a side view of the self-cleaning hydraulic bucket mounted on an excavator stick.

In FIG. 1, the hydraulic self-cleaning bucket 10 of the present invention replaces the typical bucket which is attached to the free end of the excavator stick 12 of an excavator 14. Dotted lines show the inventive wiper plate 16 inside the bucket 10. Excavator pins 22*a*, 22*b*, which are part of the original equipment on the excavator 14, attach the bucket mounting plates 18 to the excavator stick 12. Striker mounting plate 24 with striker forks 26 is mounted on the front of the excavator stick 12. Bucket hydraulic cylinder 28 rotates the hydraulic bucket 10, while arm cylinder 30 moves the excavator stick 12.

Figure 2:
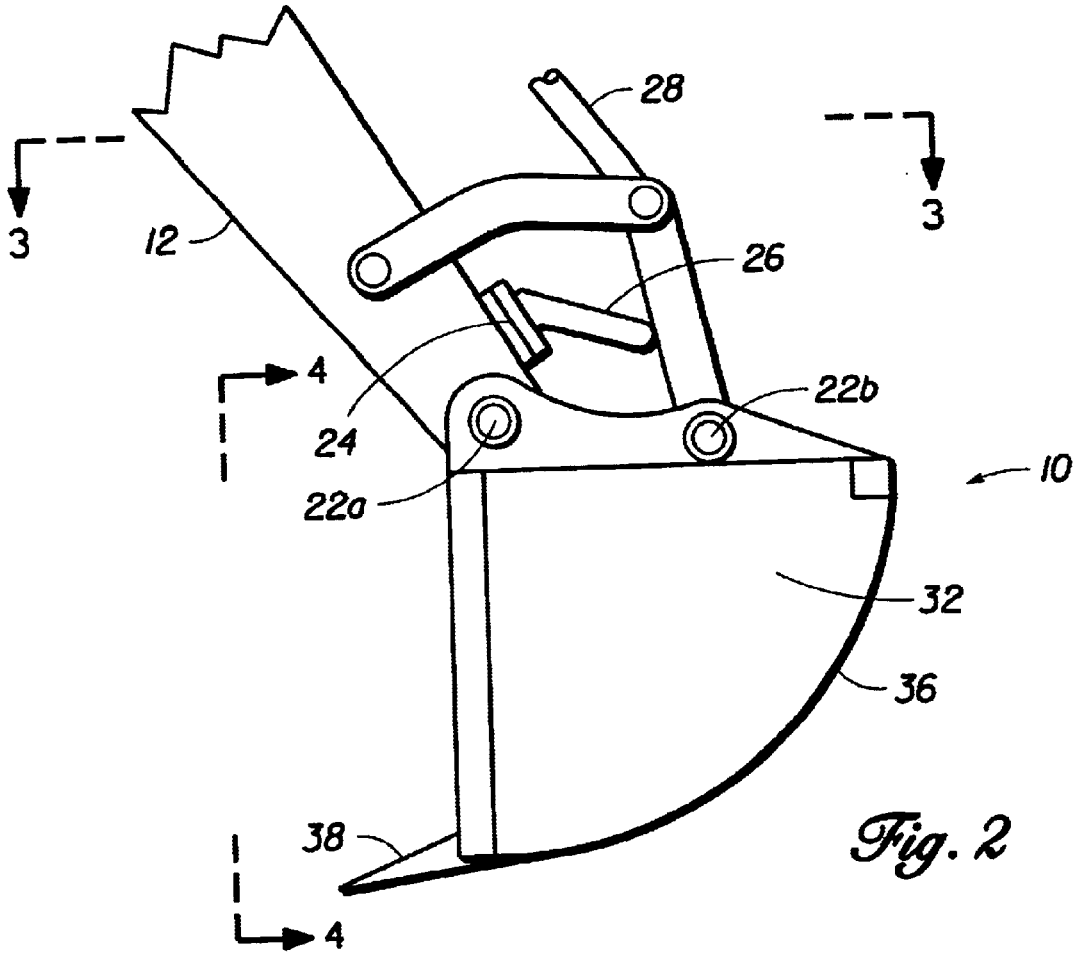
FIG. 2 shows a close-up view of the self-cleaning hydraulic bucket.

In FIG. 2, a close-up view of the bucket 10, the excavator pins 22 attach the bucket mounting plates 18, (20) to the excavator stick 12. Striker mounting plate 24 with striker forks 26 is attached to the front of the excavator stick 12 at a position which allows the striker forks 26 to clear the bucket hydraulic cylinder 28. The bucket 10 has sidewalls 32, (34) and a contoured bottom 36, with cutting teeth 38.

Figure 3:
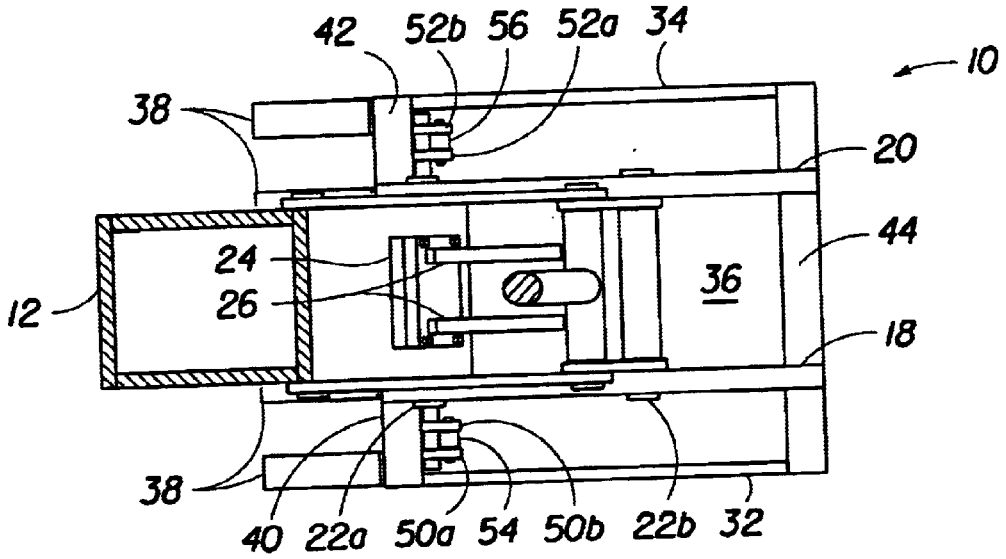
FIG. 3 shows a top view of the self-cleaning hydraulic bucket.

In FIG. 3, the self-cleaning bucket 10 has two sidewalls 32, 34, arranged parallel to each other and welded to front tube 42 and rear tube 44. The contoured bottom 36 is welded to sidewalls 32, 34, and rear tube 44, forming the bucket 10. Cutting edge 40 is welded to the front edge of the contoured bottom 36 and sidewalls 32, 34. Cutting teeth 38 are welded to the cutting edge 40. Bucket mounting plates 18, 20 are arranged parallel to each other and to sidewalls 32, 34, and are welded to front tube 42 and rear tube 44, forming a mounting frame. Bucket mounting plates 18, 20 are drilled and bored for mounting the bucket 10 onto the excavator 14, using excavator pins 22*a*, 22*b*, which are inserted through holes in the bucket mounting plates 18, 20 and pre-formed holes in the excavator 14. The wiper plate 16, which is mounted onto the front tube 42, rotates through an arc, the bottom edge sweeping along the inside of the contoured bottom 36 of the bucket 10. Mounting bars 46, 48, are welded onto the back of the wiper plate 16, extending upwardly therefrom. Pairs of pad eyes 50*a*, 50*b*, 52*a*, 52*b*, with drilled holes, are welded to the back side of front tube 42. Plate mounting pins 54, 56 are inserted through the holes in pad eyes 50*a*, 50*b*, 52*a*, 52*b* and in the mounting bars 46, 48, creating two hinges which allow the wiper plate 16 to swing and rotate within the bucket 10.

Figure 4:
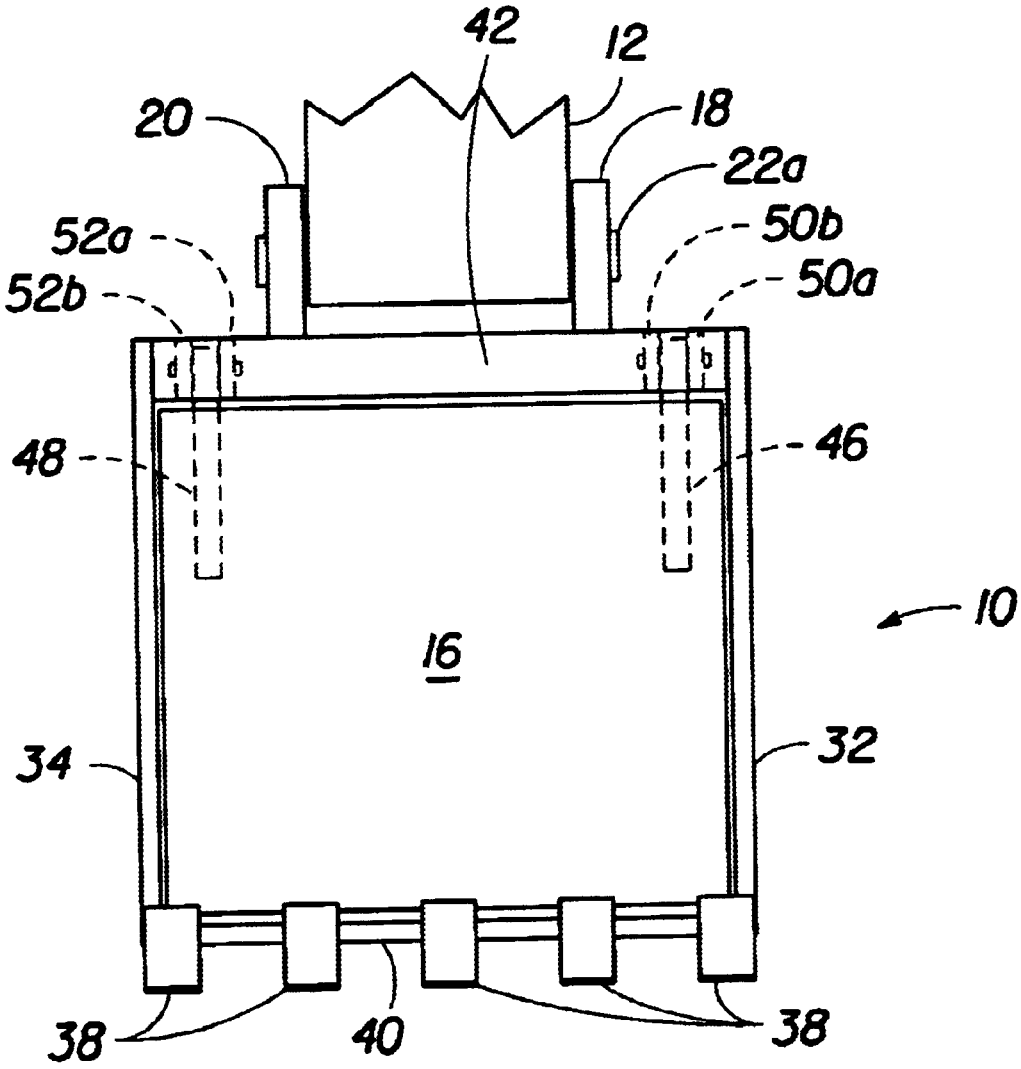
FIG. 4 shows a front view of the self-cleaning hydraulic bucket.

FIG. 4 shows the open front of the bucket 10, with the wiper plate 16 hanging from the "hinges". The dotted lines show the pairs of pad eyes 50*a*, 50*b*, 52*a*, 52*b* welded to the back side of front tube 42. An end of each of the mounting bars 46, 48 has been inserted between one of each of the pairs of pad eyes 50*a*, 50*b*, 52*a*, 52*b* and secured with plate mounting pins 54, 56. The view also shows the front of bucket mounting plates 18, 20, which are mounted onto the excavator stick 12 with excavator pins 22*a*, (22*b*), as well as the cutting teeth 38, which are welded to the cutting edge 40.

FIGS. 5A–5D show the hydraulic self-cleaning bucket 10 performing a typical operation. As noted supra, the standard bucket has been removed from the excavator stick 12 and replaced with the bucket 10 of the present invention, which hangs on the excavator stick 12. Valve manifolds (not shown) are connected to the bucket hydraulic cylinder 28. The valve (not shown) is closed, directing oil through the hydraulic hoses (not shown) to the bucket hydraulic cylinder 28. A standard control lever on the operator control panel is moved one way to rotate the bucket 10 and fill it; reversing the lever rotates the bucket 10 in the opposite direction in order to empty it.

Figure 5A:
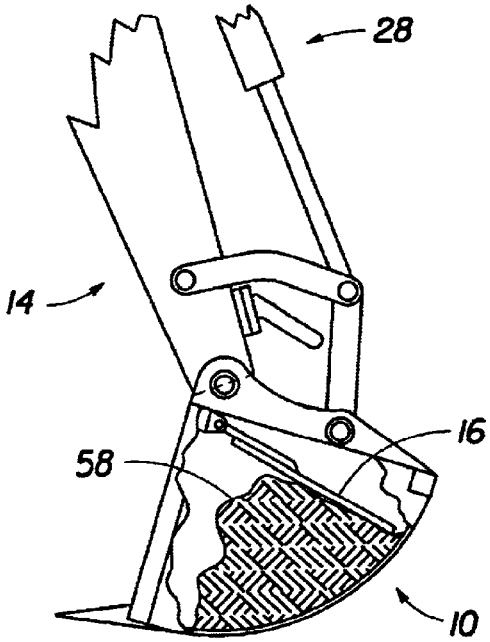
FIGS. 5A–5D show side views of the self-cleaning hydraulic bucket in operation; the side of the bucket is "see-through", showing the wiper plate and the contents of the bucket.

In FIG. 5A, dirt 58 or other material has been scooped into the bucket 10 by the hydraulically-powered excavator 14. The wiper plate 16, which is rotated by the hydraulic cylinder 28, has moved to the top of the bucket 10 as the dirt 58 is forced into the bucket 10. When the bucket 10 is full it is raised and swung over the dump area.

Figure 5B:
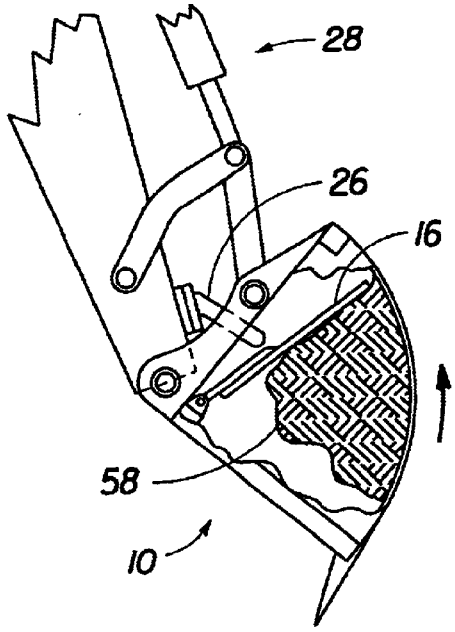

As shown in FIG. 5B, the inward movement of bucket hydraulic cylinder 28 causes the bucket 10 to rotate in order to empty it. As the bucket 10 rotates, the wiper plate 16 comes in contact with striker forks 26, which force wiper plate 16 to eject the dirt 58 from inside the bucket 10.

Figure 5C:
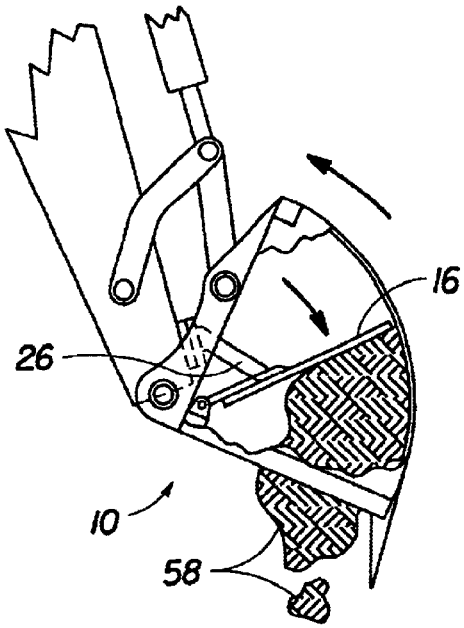

In FIG. 5C, the bucket 10 continues to rotate, while the striker forks 26 keep the wiper plate 16 from moving with the bucket 10, effectively forcing the dirt 58 out of the bucket 10.

Figure 5D:
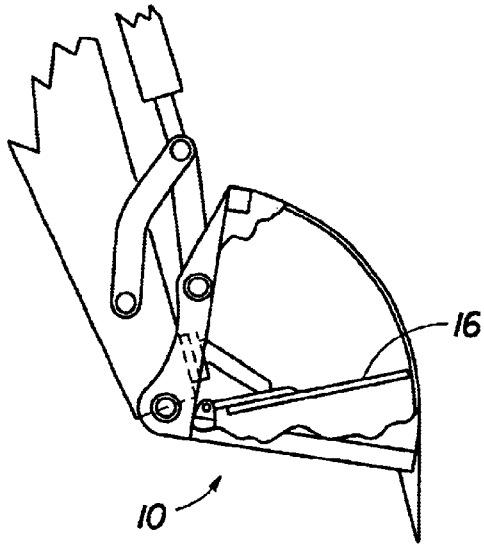

In FIG. 5D, the wiper plate 16 is ejecting the last remnants of dirt 58 from the bucket 10. The bucket 10 will be swung back over the excavation area, and the process will be repeated until the desired area is excavated.

Conclusion, Ramification, and Scope

Accordingly, the reader will see that this self-cleaning hydraulic bucket can be used to excavate areas effectively. In addition:

- It requires no added expense of additional hydraulic pump controls and lines to operate.
- It requires no additional training of the operator because it works off the standard controls of the machine in the same manner as the standard bucket, thus, eliminating the possibility of an accident because of an unfamiliar operation.
- The bucket is self-cleaning allowing mud or other sticky material to be removed from inside the bucket, thus no build up of material inside the bucket, increasing productivity and eliminating an age old problem in the industry.
- The bucket reduces the exposure of workers to contaminated materials and hazardous waste.

Although the description above contains many specifics, these should not be construed as limiting the scope of the invention, but merely providing illustrations of the presently preferred embodiments of this self-cleaning hydraulic bucket. Thus, the scope of the self-cleaning hydraulic bucket should be determined by the applied claims and their legal equivalents rather than by the examples given.

I claim:

1. A hydraulic, self-cleaning bucket assembly for attachment to a stick assembly of an excavator, wherein the self-cleaning bucket assembly comprises:

- a bucket comprising two sidewalls, a contoured bottom, and two square tubing pieces, all welded together to form the bucket;
- a wiper plate rotatably mounted onto one of the square tubing pieces, said wiper plate being movable through a 135° arc and having an edge movable along the contoured bottom;
- means for mounting the bucket onto the stick assembly;
- a striker assembly separately mounted onto the stick assembly, said striker assembly being positioned to stop rotation of the wiper plate past a predetermined point as the bucket continues to rotate when said bucket is being emptied;
- a hydraulic cylinder with a manifold and a line, said hydraulic cylinder effectuating rotation of the bucket.

2. The bucket assembly of claim 1, wherein the striker assembly has openings, and which further comprises two spaced-apart pre-drilled bucket mounting plates welded to the square tubing pieces, and wherein the means for mounting the bucket onto the stick assembly comprises pins, said pins being inserted through the pre-drilled bucket mounting plates and the opening in the stick assembly.

3. The bucket assembly of claim 1 wherein welded onto one of the square tubing pieces are two pairs of pad eyes, each pad eye having a hole for a wiper mounting pin, and wherein the wiper plate has two pre-drilled mounting extensions, the wiper plate being rotatably mounted onto said square tubing piece by inserting one of the pre-drilled mounting extensions between each pair of pad eyes and then inserting the wiper plate mounting pin through each pair of pad eyes.

4. The bucket assembly of claim 1 wherein the striker assembly comprises a mounting plate with two spaced-apart prongs projecting therefrom.

* * * * *